US009900681B2

(12) United States Patent
Hayden

(10) Patent No.: US 9,900,681 B2
(45) Date of Patent: Feb. 20, 2018

(54) EARBUD HEADPHONE ADAPTER

(71) Applicant: Inca Street Sound, LLC, Denver, CO (US)

(72) Inventor: Thomas G. Hayden, Denver, CO (US)

(73) Assignee: Inca Street Sound, LLC, Denver, CO (US)

( * ) Notice: Subject to any disclaimer, the term of this patent is extended or adjusted under 35 U.S.C. 154(b) by 0 days.

(21) Appl. No.: 15/062,088

(22) Filed: Mar. 5, 2016

(65) Prior Publication Data

US 2016/0261942 A1 Sep. 8, 2016

Related U.S. Application Data

(60) Provisional application No. 62/128,850, filed on Mar. 5, 2015.

(51) Int. Cl.
*H04R 25/00* (2006.01)
*H04R 1/10* (2006.01)

(52) U.S. Cl.
CPC ..... *H04R 1/105* (2013.01); *H04R 1/1016* (2013.01); *H04R 1/1058* (2013.01)

(58) Field of Classification Search
CPC ..... H04R 1/105; H04R 1/1016; H04R 1/1058
USPC ..... 381/380
See application file for complete search history.

(56) References Cited

U.S. PATENT DOCUMENTS

D388,093 S 12/1997 Frengley
D558,735 S 1/2008 Carr
D618,219 S 6/2010 Burgett
D622,265 S 8/2010 Rye
7,949,127 B2 5/2011 Pedersen
(Continued)

FOREIGN PATENT DOCUMENTS

WO WO/2010040350 4/2010
WO WO/2012138788 11/2012
(Continued)

OTHER PUBLICATIONS

Yurbuds Sport Headphones, http://www.jbl.com/yurbuds-sport-headphones/?adpos=1t1&creative=84121232455&device=c&matchtype=b&network=g&gclid=CNPOvprDxcsCFQmqaQodkVkF2g (last visited Mar. 15, 2016).

(Continued)

*Primary Examiner* — Sean H Nguyen
(74) *Attorney, Agent, or Firm* — University of Colorado Entrepreneurial Law Clinic

(57) ABSTRACT

Embodiments include an earbud headphone adapter configured to securely retain an earbud headphone in a user's ear, preserve the quality of sound emitted from the earbud headphone into a user's ear, and/or reduce the discomfort commonly experienced by users from prolonged wearing of an earbud headphone. A hollow body having a cavity extending from a first plane to an earbud opening about an axis substantially perpendicular to a second plane is configured to stretch over and securely retain an earbud headphone. A portion of the hollow body may taper from the earbud opening to a sound opening. A stabilizer extends from the hollow body generally along the first plane and is configured to engage with the concha area of a user's ear while the sound opening is within the ear canal opening to securely retain the earbud adapter and earbud headphone in the user's ear.

10 Claims, 15 Drawing Sheets

(56) References Cited

U.S. PATENT DOCUMENTS

| | | | | |
|---|---|---|---|---|
| D641,737 | S | 7/2011 | Krauss | |
| D645,458 | S | 9/2011 | Silvestri | |
| D655,693 | S | 3/2012 | Silvestri | |
| D659,117 | S | 5/2012 | Krauss | |
| 8,249,287 | B2 | 8/2012 | Silvestri | |
| 8,254,621 | B2 | 8/2012 | Silvestri | |
| 8,311,253 | B2 | 11/2012 | Silvestri | |
| D686,197 | S | 7/2013 | Kurtz | |
| D695,266 | S | 12/2013 | Schaal | |
| 8,737,669 | B2 | 5/2014 | Monahan | |
| 8,929,582 | B2 | 1/2015 | Silvestri | |
| 8,989,426 | B2 | 3/2015 | Silvestri | |
| D728,532 | S | 5/2015 | Kurtz | |
| 9,161,114 | B2 | 10/2015 | Bone | |
| 2002/0131585 | A1 | 9/2002 | Jones | |
| 2005/0141739 | A1* | 6/2005 | Juneau | H04R 25/60 381/322 |
| 2006/0067556 | A1 | 3/2006 | Bailey | |
| 2007/0116309 | A1 | 5/2007 | Smith | |
| 2008/0002835 | A1 | 1/2008 | Sapiejewski | |
| 2011/0182454 | A1 | 7/2011 | Laresn | |
| 2012/0039501 | A1* | 2/2012 | Silvestri | H04R 1/1075 381/380 |
| 2012/0057739 | A1 | 3/2012 | Smith | |
| 2012/0128192 | A1 | 5/2012 | Burgett | |
| 2012/0237074 | A1 | 9/2012 | Aase | |
| 2013/0230204 | A1 | 9/2013 | Monahan | |
| 2013/0343595 | A1* | 12/2013 | Zorkendorfer | H04R 1/10 381/380 |
| 2014/0068944 | A1 | 3/2014 | Aase | |
| 2014/0119589 | A1 | 5/2014 | Wyzisk | |
| 2014/0138179 | A1 | 5/2014 | Burton | |
| 2014/0241563 | A1 | 8/2014 | Monahan | |
| 2014/0270315 | A1 | 9/2014 | Burgett | |
| 2014/0286515 | A1* | 9/2014 | Bone | H04R 1/1016 381/328 |
| 2015/0115871 | A1 | 4/2015 | Feril | |
| 2015/0312672 | A1 | 10/2015 | Kurtz | |

FOREIGN PATENT DOCUMENTS

| | | |
|---|---|---|
| WO | WO/2013016336 | 1/2013 |
| WO | WO/2014017922 | 1/2014 |

OTHER PUBLICATIONS

DigiHero EarPod Covers, http://www.amazon.com/DigiHero-Earbuds-Ear-Hook-Attachment-Compatible/dp/B013LBSYMK (last visited Mar. 15, 2016).

EarSkinz, http://earskinz.com/collections/es2 (last visited Mar. 15, 2016).

Earhoox, http://earhoox.com/shop/#for-earpods (last visited Mar. 15, 2016).

Freebit Earbud, http://freebit.eu/earbud/ (last visited Mar. 15, 2016).

Far End Gear BudLoks Earphone Sport Grips, http://farendgear.com/budloks/earpod.php (last visited Mar. 15, 2016).

* cited by examiner

EARBUD HEADPHONE ADAPTER

CROSS REFERENCE

This application is a non-provisional application claiming the benefit of Provisional Application No. 62/128,850 filed Mar. 5, 2015, which is incorporated by reference herein in its entirety for all purposes.

TECHNICAL FIELD

The present disclosure relates to adapters for earbud headphones.

BACKGROUND

Earbuds are generally a small type of headphone worn inside the ear. For example, earbuds are usually held in place by fitting in the cavum concha of the outer ear, and may at least partially insert into the ear canal of the user. Earbuds have many benefits over traditional over-ear headphones, such as improved storage and transportation due to a smaller size, an ability to be worn with hats and other head apparel, and a minimalist look. Typical earbuds comprise a housing which contains the speaker components and electrical connectivity through cords running to a media player device. However, earbuds are generally more susceptible to falling out of the ear of a user or becoming uncomfortable when worn over prolonged periods of time.

BRIEF SUMMARY

Among other things, embodiments provide for fitting an earbud into a human ear comfortably and securely while maintaining a high sound quality. For example, some embodiments are implemented as an earbud adapter structure having features that conform to fit securely over an earbud, features that comfortably secure the earbud in a wearer's ear (e.g., within the cymba concha and outer ear canal), and features that enable high sound quality and the like. In other embodiments, the earbud adapter may be implemented directly into the structure of the earbud headphone itself. Some embodiments are implemented by a hollow body having an earbud opening. The earbud opening extends about an earbud axis that is substantially perpendicular to a first plane. The earbud opening is configured to fit over an earbud headphone, and the hollow body tapers along at least a portion of the hollow body from the earbud opening to a sound opening according to an embodiment. The sound opening extends about a sound opening axis, where the sound opening axis is substantially perpendicular to a second plane. The first plane is parallel and offset from the second plane. The earbud opening has a cross-sectional area that is larger than the cross-sectional area of the sound opening, according to some embodiments. In some embodiments, a first distance between opposite sides of the cavity on the first plane is larger than a second distance between opposite sides of the cavity on the third plane. The sound opening of the hollow body is dimensioned to fit within an ear canal opening of a human ear. In some embodiments the sound opening axis is offset from the earbud axis in a first direction.

According to one embodiment, the earbud adapter has a stabilizer extending from the hollow body. The stabilizer is configured to engage with a cymba concha area of the ear while the sound opening is within the ear canal. The stabilizer extends generally along the first plane from a portion of the hollow body that is offset from the earbud axis in a second direction; the second direction generally opposite from the first direction.

According to another embodiment, the hollow body further comprises a cavity extending from the first plane to a third plane; the third plane being offset in an opposite direction to the first plane. The cavity has a larger cross-sectional area on the first plane than on the third plane. The cavity is configured to receive an earbud headphone and is formed of a material configured to stretch over the earbud headphone to securely retain it. At least one side of the cavity configured to conform to at least one side of an earbud headphone when the earbud headphone is inserted into the hollow body, in certain embodiments.

According to another embodiment, the hollow body of the earbud headphone adapter comprises a third opening located between the first plane and the second plane. The third opening is offset from the earbud axis along the second direction. The third opening may reduce vibratory feedback caused by sound emitted from the earbud headphone.

In some embodiments, the hollow body of the earbud headphone adapter may have a uniform wall thickness. Additionally, the earbud headphone adapter may be made from a silicone material; the silicone material may have a 55 shore A durometer hardness.

In some embodiments, the stabilizer has a first arm and a second arm; the first arm and the second arm each extend from the hollow body at separate locations; the location that the first arm extends from the hollow body is substantially opposite from the sound opening. The first and second arm join at a point, where the point is configured to contact a cymba concha area of the ear while the sound opening is within the ear canal opening.

BRIEF DESCRIPTION OF THE DRAWINGS

The accompanying figures illustrate one or more embodiments of the disclosed earbud headphone adapter, and together with the detailed description serve to explain the aspects and implementations of the earbud headphone adapter. Embodiments are described in conjunction with the appended figures.

DETAILED DESCRIPTION

All illustrations of the drawings are for the purpose of describing selected embodiments and are not intended to limit the scope of the claims. The following detailed description of the drawings, along with the preceding brief description of the drawings, utilizes a directional convention to promote clarity. Vertically descriptive terms, such as top and bottom or up and down, relate to directions, locations, or view orientations of the earbud headphone adapter when worn in the ear of a user. The "front" of the earbud headphone adapter is the part or side which interfaces with the ear of a user when worn. The "back" of the earbud headphone adapter is the part or side which receives an earbud headphone and is thus generally opposite the front. The "sides" of the earbud headphone adapter correspond to the part or sides which are neither the back, front, top, nor bottom of the earbud headphone adapter.

Figure 1:
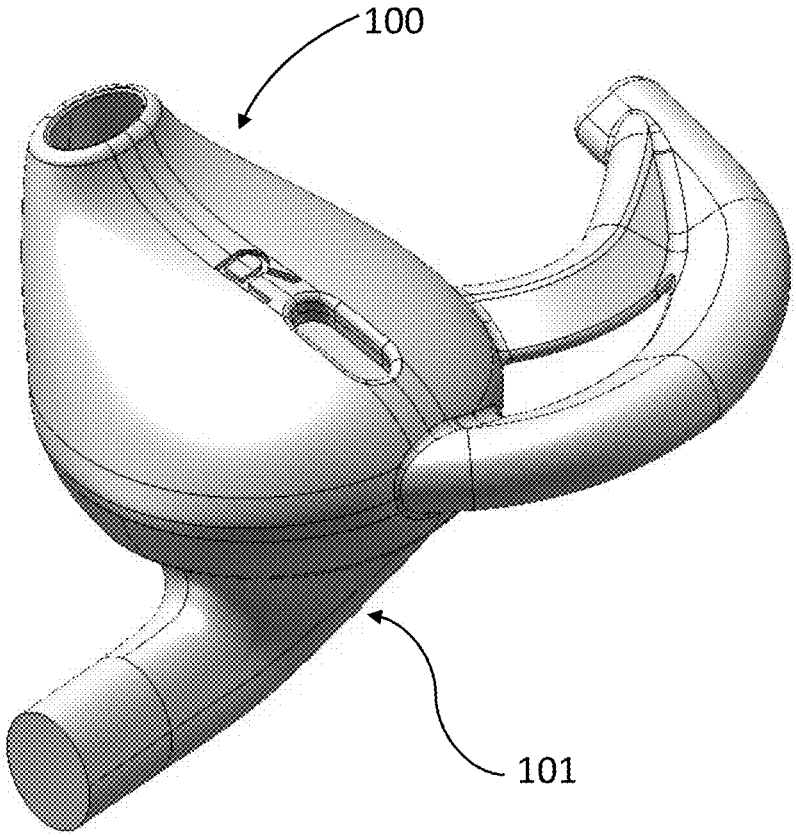
FIG. 1 shows a perspective view of the front of an earbud headphone that has an earbud headphone adapter fitted over a portion of the earbud headphone.
Figure 7:
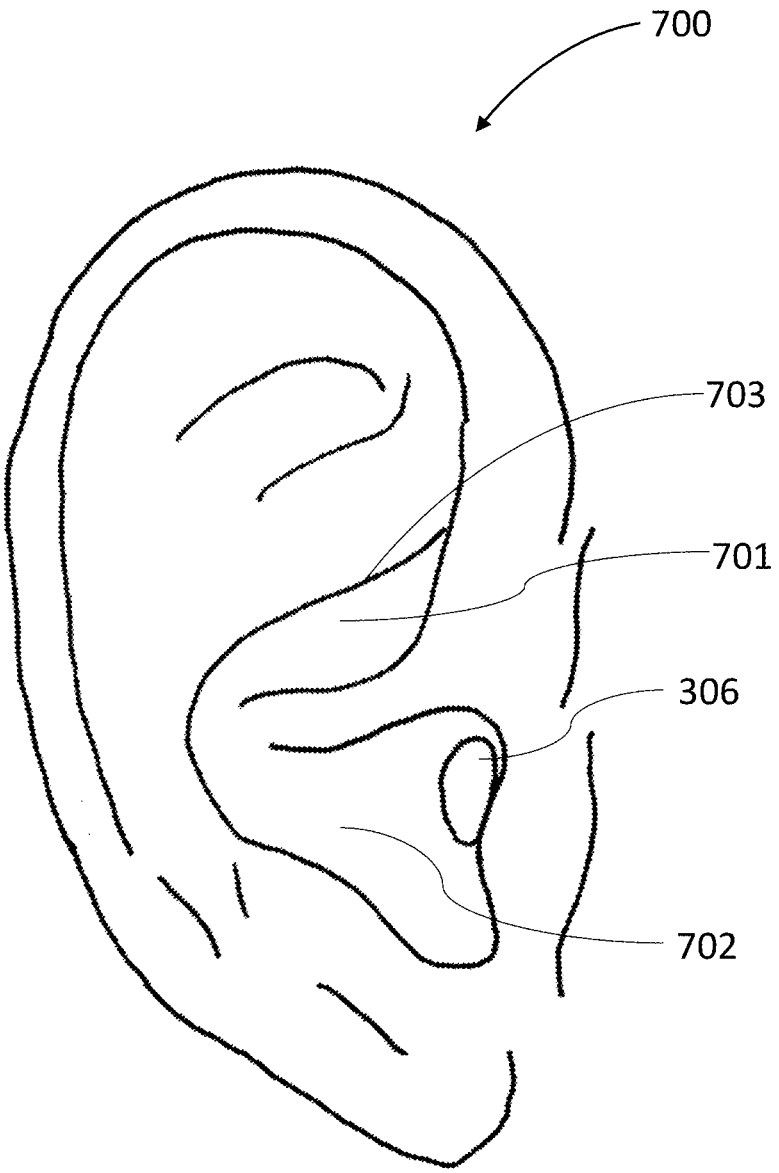
FIG. 7 shows a view of a human ear.
Figure 8:
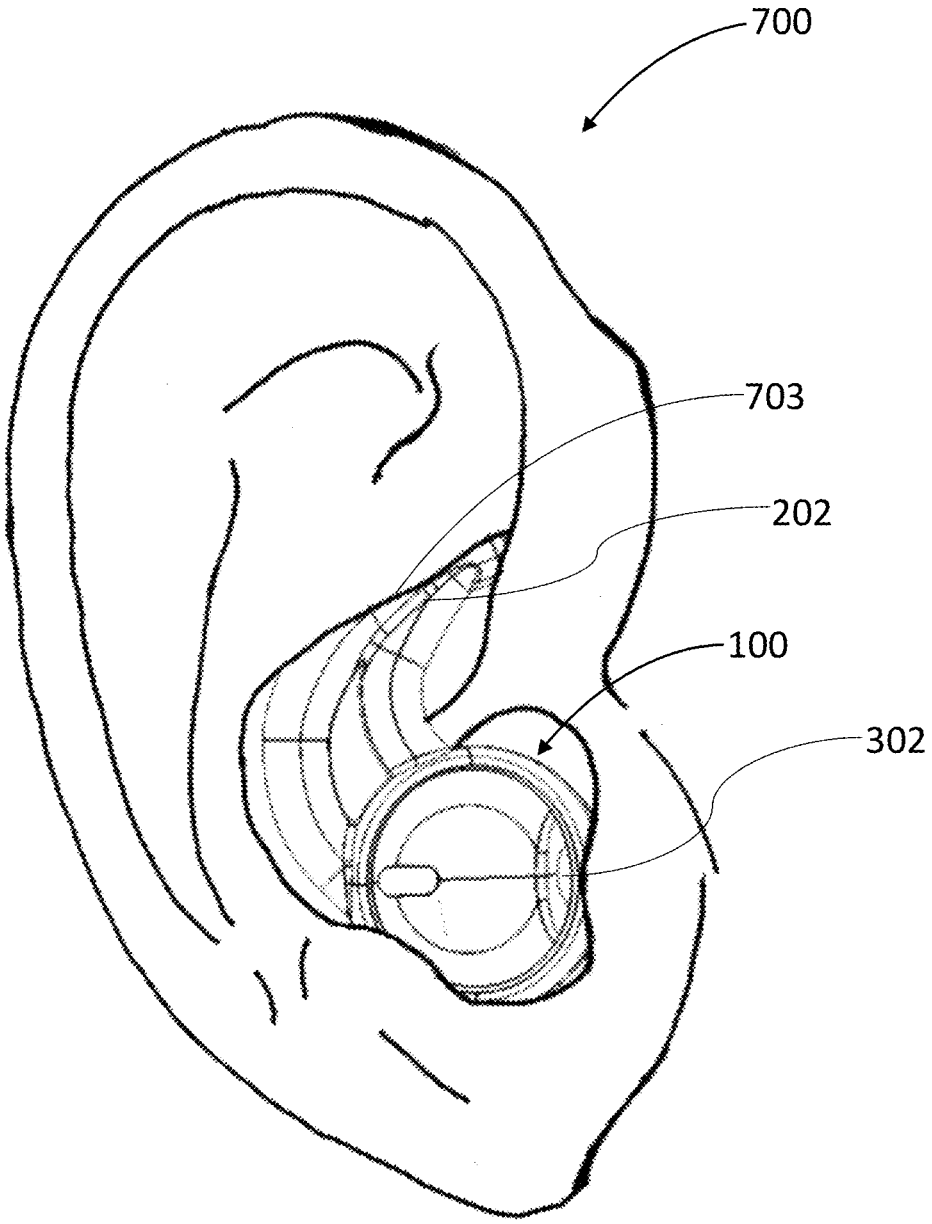
FIG. 8 shows a view of an earbud headphone adapter positioned in a human ear.
Figure 9:
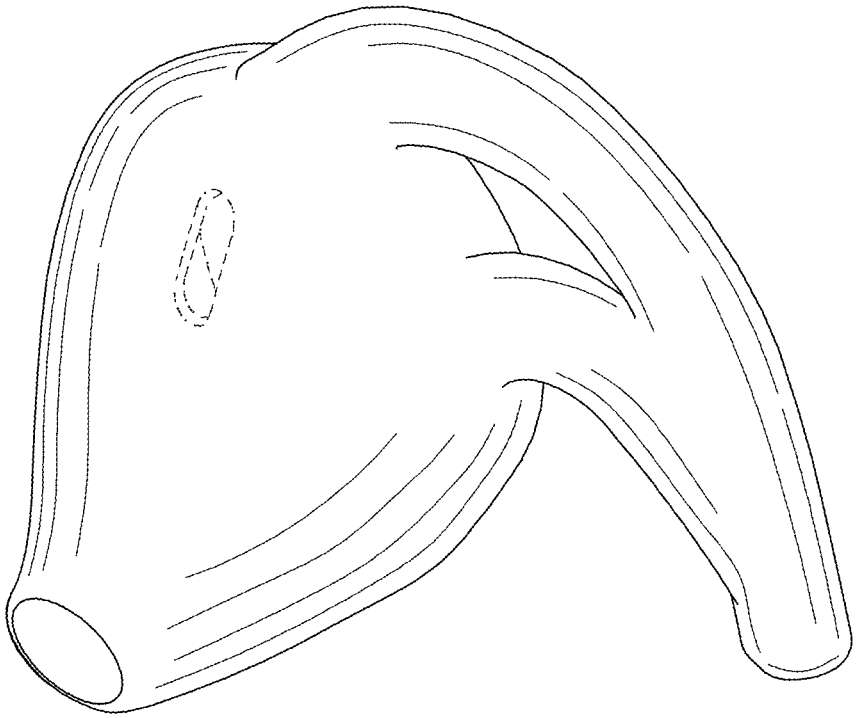
FIG. 9 shows a perspective view of the front of an earbud headphone adapter.
Figure 10:
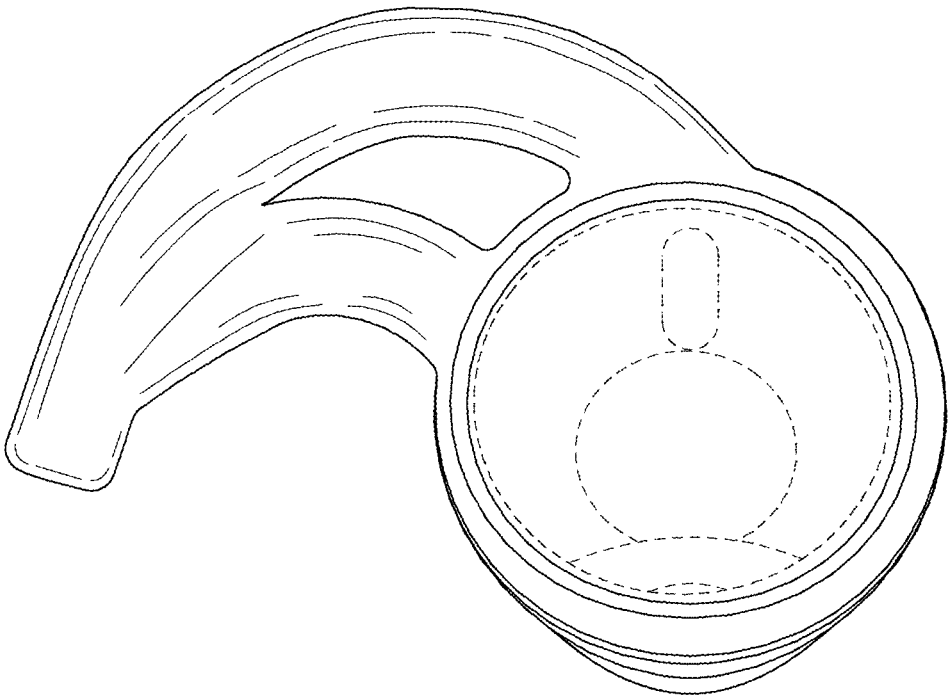
FIG. 10 shows a back view of the earbud headphone adapter of FIG. 9.
Figure 11:
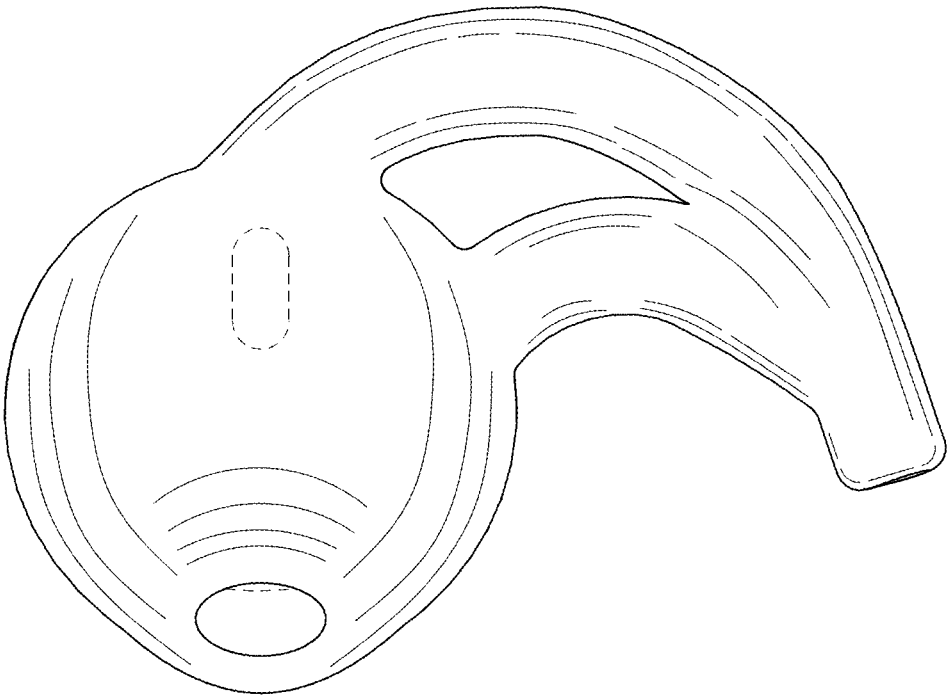
FIG. 11 shows a front view of the earbud headphone adapter of FIG. 9.
Figure 12:
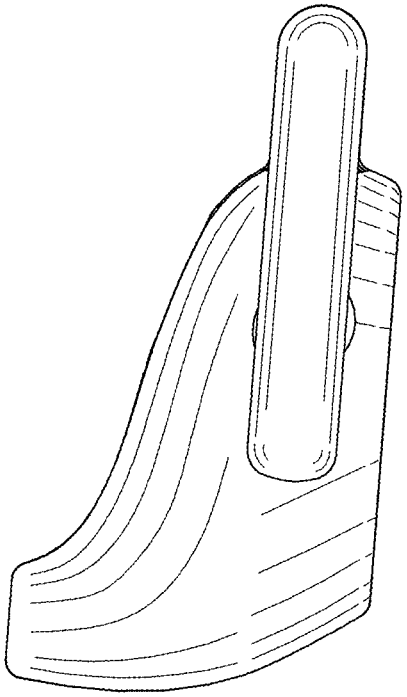
FIG. 12 shows a first side view of the earbud headphone adapter of FIG. 9.
Figure 13:
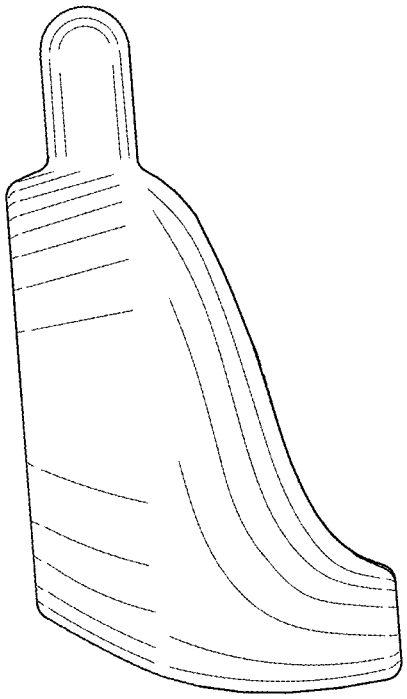
FIG. 13 shows a second side view of the earbud headphone adapter of FIG. 9.
Figure 14:
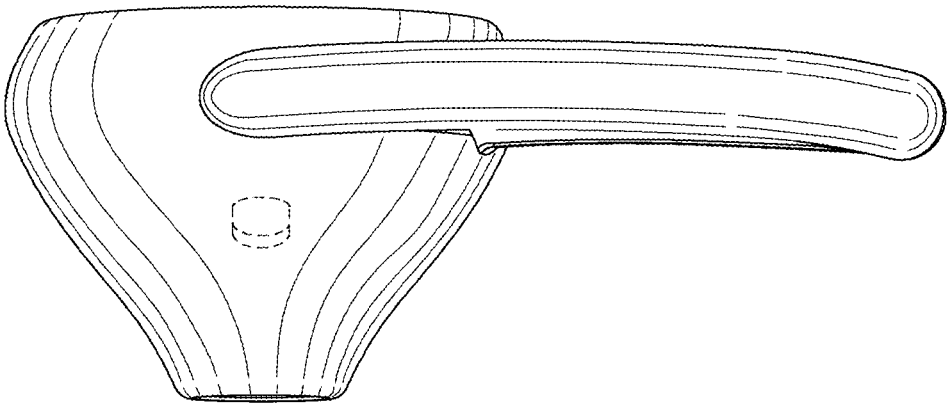
FIG. 14 shows a top view of the earbud headphone adapter of FIG. 9.
Figure 15:
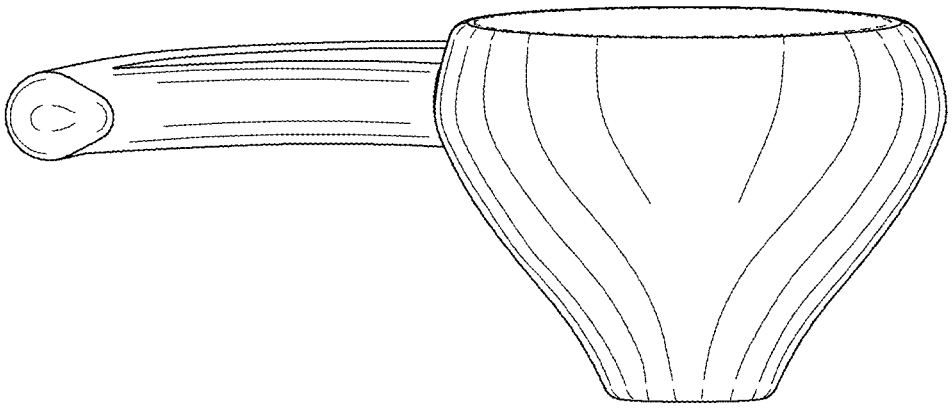
FIG. 15 shows a bottom view of the earbud headphone adapter of FIG. 9.

FIG. 1 shows one embodiment of an earbud headphone adapter 100 coupled to an earbud headphone 101. The earbud headphone adapter 100 fits over the earbud headphone 101 to alter how the earbud headphone 101 interacts, or interfaces, with an ear of a user (as shown in FIGS. 7 and 8, for example). The earbud headphone adapter 100 may be made of any suitable material known in the art such that the earbud headphone adapter 100 is capable of fitting over and securely coupling to the earbud headphone 101. For instance, one such suitable material is silicone, which, in addition to providing flexibility of the earbud headphone adapter 100, has the added benefits of a low cost, ease of use in manufacturing, soft cushioning for a user's comfort, and/or the capacity to promote hygiene by being readily washable and/or a relatively resistant media to biological growth.

Figure 2:
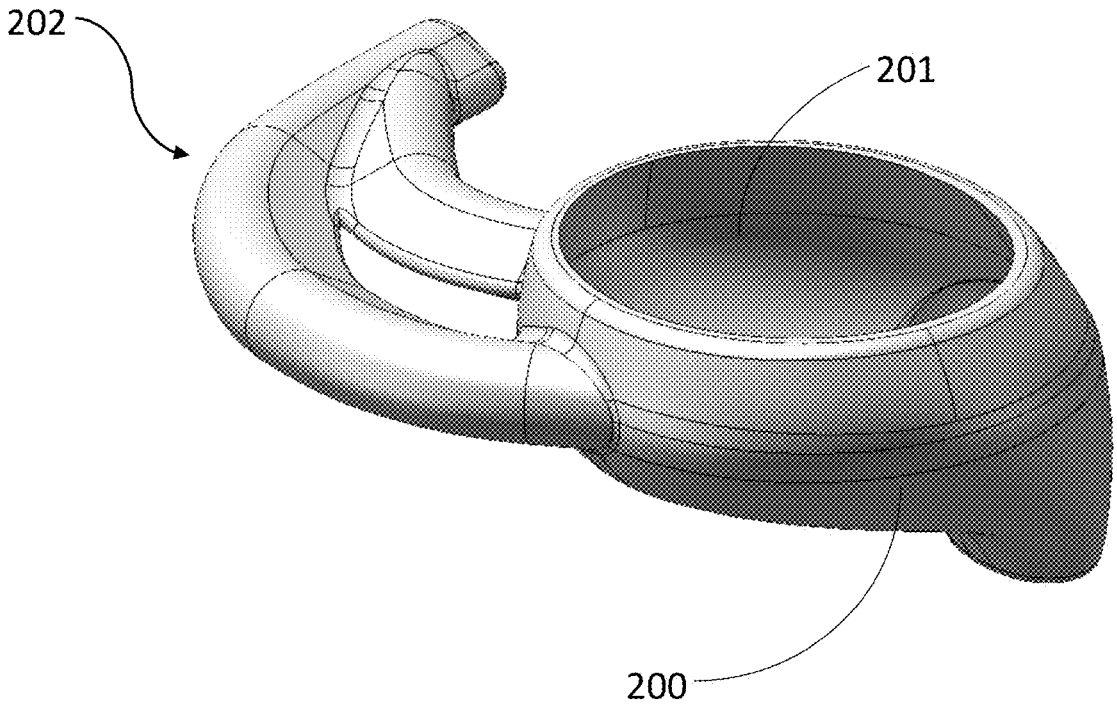
FIG. 2 shows a perspective view of the back of the earbud headphone adapter of FIG. 1.

FIG. 2 shows an embodiment of the earbud headphone adapter 100 from a back perspective view. The earbud headphone adapter 100 comprises a hollow body 200, an earbud opening 201, and a stabilizer 202. An earbud headphone 101 may be inserted into the earbud opening 201 where the earbud headphone 101 is received and secured by the hollow body 200. During use, in one embodiment, the stabilizer 202 is shaped to interface with features of a human outer ear and is attached to the hollow body 200. For example, the stabilizer 202 can secure the earbud headphone adapter 100 in place by fitting into and applying pressure to a cymba concha area located under the crus of antihelix in a human ear, as disclosed in FIGS. 7 and 8 and described in more detail below.

Figure 3:
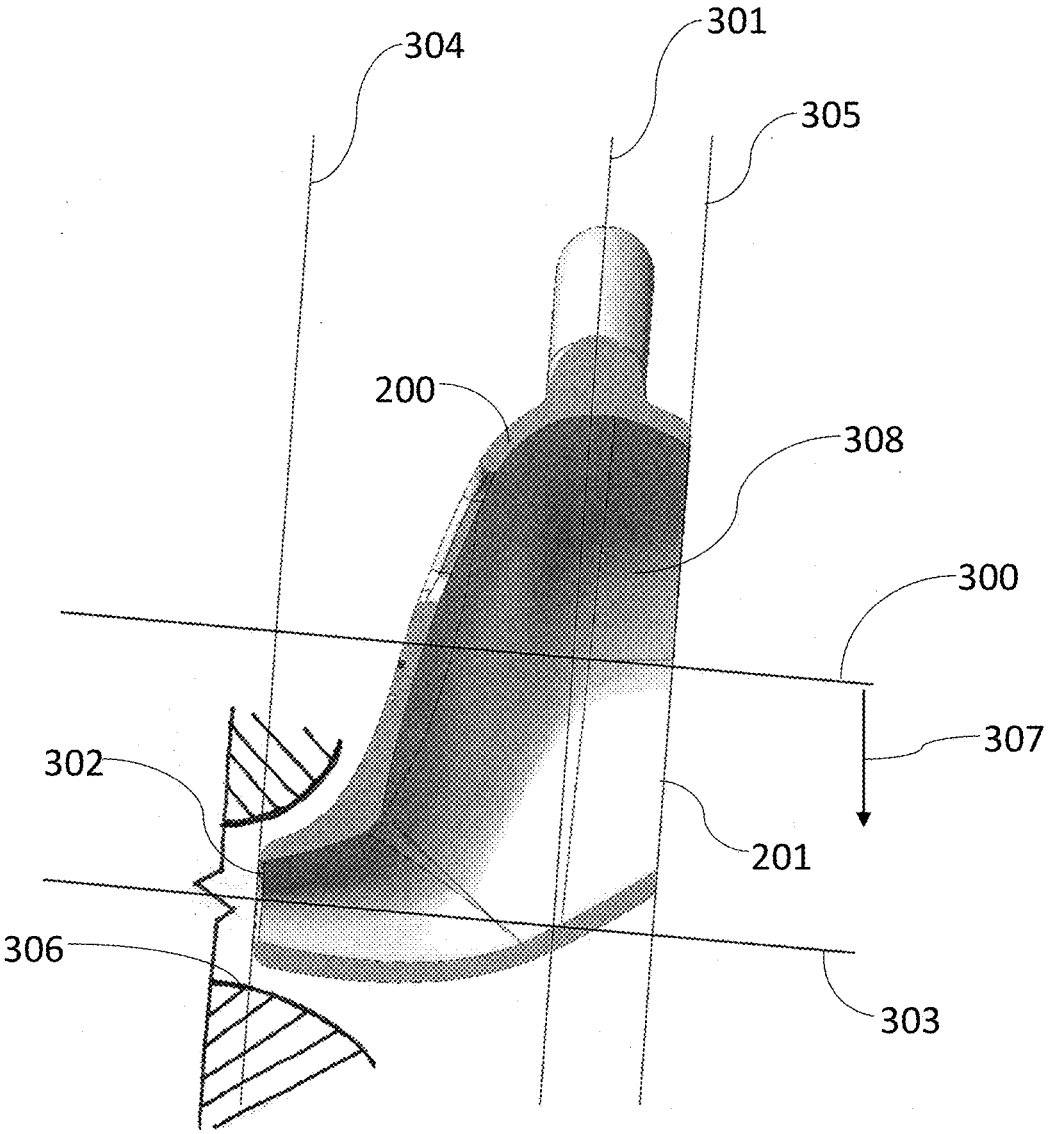
FIG. 3 shows a side, cross-sectional view of the earbud headphone adapter of FIG. 1 taken along plane A-A of FIG. 6.
Figure 6:
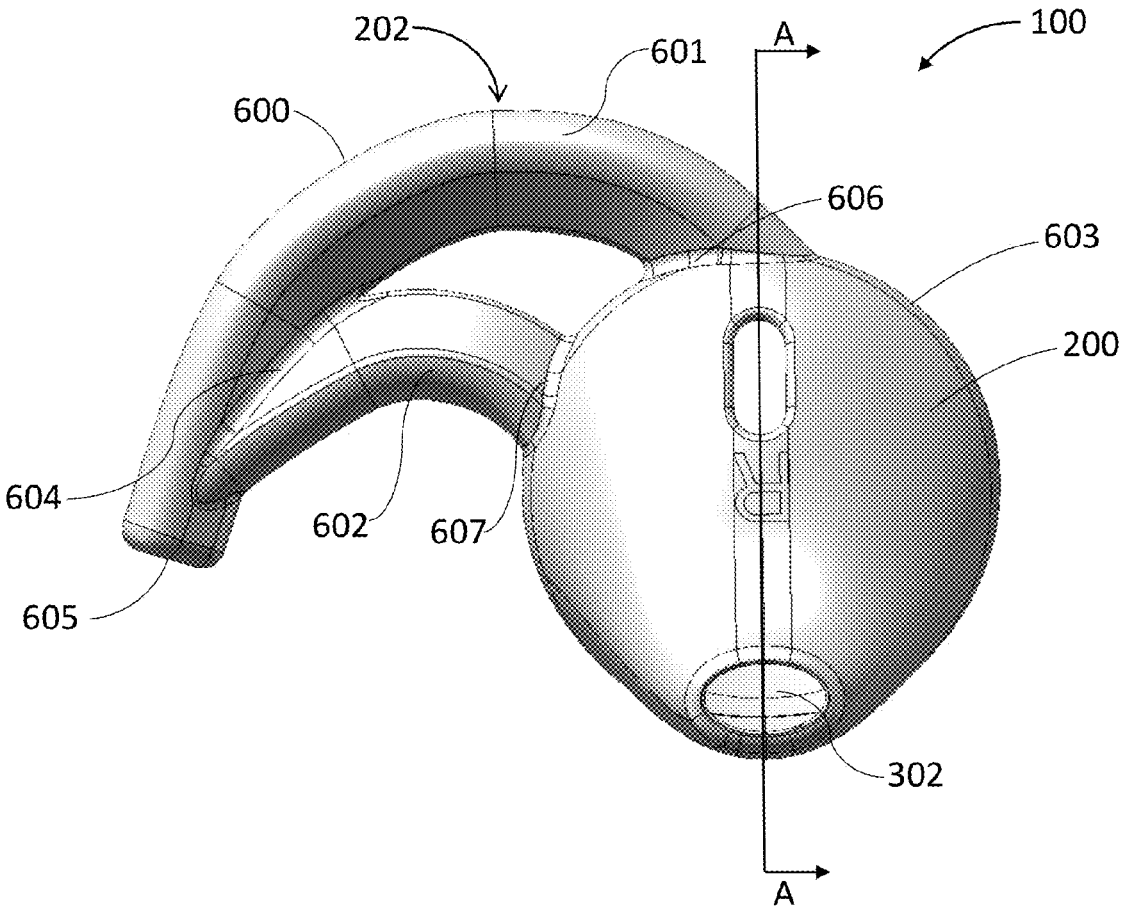
FIG. 6 shows a front view of the earbud headphone adapter of FIG. 1.

FIG. 3 shows a cut-away view of the earbud headphone adapter 100 taken along plane A-A of FIG. 6. An earbud headphone 101 may be inserted into the hollow body 200 through the earbud opening 201. When the earbud headphone 101 emits sound, the sound travels through the hollow body 200 and exits through a sound opening 302 into an ear canal opening 306 of a user (see also FIG. 7). The sound opening 302 is therefore dimensioned to fit within the ear canal opening 306 of a user when the earbud headphone adapter 100 is fitted over an earbud headphone worn by the user, according to one embodiment. Further, the hollow body 200 may have a uniform wall thickness throughout, which advantageously facilitates the manufacturing process and integrity of the structure.

FIG. 3 also includes various superimposed axes and planes that are identified relative to each other and the structure of the earbud headphone adapter 100. The structure of the hollow body 200 according to one embodiment may be described in terms of its relationships to the axes and planes defined in FIG. 3. In some embodiments an earbud axis 300 is substantially perpendicular to a first plane 301. A sound opening 302 is formed about a sound opening axis 303; in some embodiments, the sound opening axis 303 is substantially perpendicular to a second plane 304. The sound opening 302 may extend along the second plane 304. The earbud opening 201 is formed about the earbud axis 300; in some embodiments, the earbud axis 300 is substantially perpendicular to a third plane 305. The earbud opening 201 may extend along the third plane 305.

The earbud opening 201 may have first cross-sectional area on the third plane 305, and the sound opening 302 may have a second cross-sectional area on the second plane 304. In one embodiment, the hollow body 200 tapers along at least a portion of the hollow body 200 from the earbud opening 201 to the sound opening 302 such that the first cross-sectional area is larger than the second cross-sectional area. As used herein, "taper" generally refers to a gradual change in size in any suitable manner (e.g., according to a constant slope, according to an arc, in a step-wise manner, etc.) and in any suitable direction (e.g., from larger to smaller, from smaller to larger, from a starting size to larger then to smaller, etc.). For example, the tapering of the hollow body 200 from the earbud opening 201 to the sound opening 302 may get both wider and narrower as the tapering progresses. Further, the sound opening axis 303 is offset from the earbud axis 300 along a first direction indicated by arrow 307, the first direction 307 may only be one component of the first direction and is generally oriented vertically downwards when the earbud headphone adapter 100 is worn in the ear of a user. Such an arrangement of the earbud headphone adapter 100 may comply with the anatomical structure of a user's ear, by positioning the sound opening 302 in the ear canal opening 306 such that in certain embodiments the sound opening axis 303 extends directly into the center of the ear canal opening 306 of a user.

In another embodiment, the hollow body 200 may have a region that forms a cavity 308. The cavity 308 extends from the first plane 301 to the third plane 305, the cavity terminating at the third plane 305 to form the earbud opening 201. The cavity 308 has a larger cross-sectional area on the first plane 301 as compared to the third plane 305. This is so the cavity 308 may at least partially stretch over an earbud headphone 101 so as to securely retain the earbud headphone 101 inserted through the earbud opening 201 into the hollow body 200 according to such embodiments. In some embodiments, a first distance between opposite sides of the innermost wall of the cavity 308 on the first plane 301 is larger than a second distance between opposite sides of the innermost wall of the cavity 308 on the third plane 201. Thus, the cavity 308 may be made of any suitable material having an adequately flexible compliance such that the cavity 500 is capable of being stretched or fitted over the earbud headphone 101 as it enters the hollow body 200. In this way, at least one side of the cavity 308 conforms to and/or "grips" the earbud headphone 101 when the earbud headphone 101 is inserted into the hollow body 200. This aspect therefore substantially improves the functionality of the earbud headphone adapter 100 in preventing the earbud headphone 101 from falling out, according to one embodiment of the present disclosure. According to another embodiment, the cavity 308 tightly conforming to the earbud headphone 101 provides additional benefits such as: creating a seal that further directs sound out of the sound opening 302; increasing comfort of the user; or maintaining a closer vibratory relationship between the sound opening 302 and other features of the earbud headphone adapter 100, such as the stabilizer 202.

Figure 4:
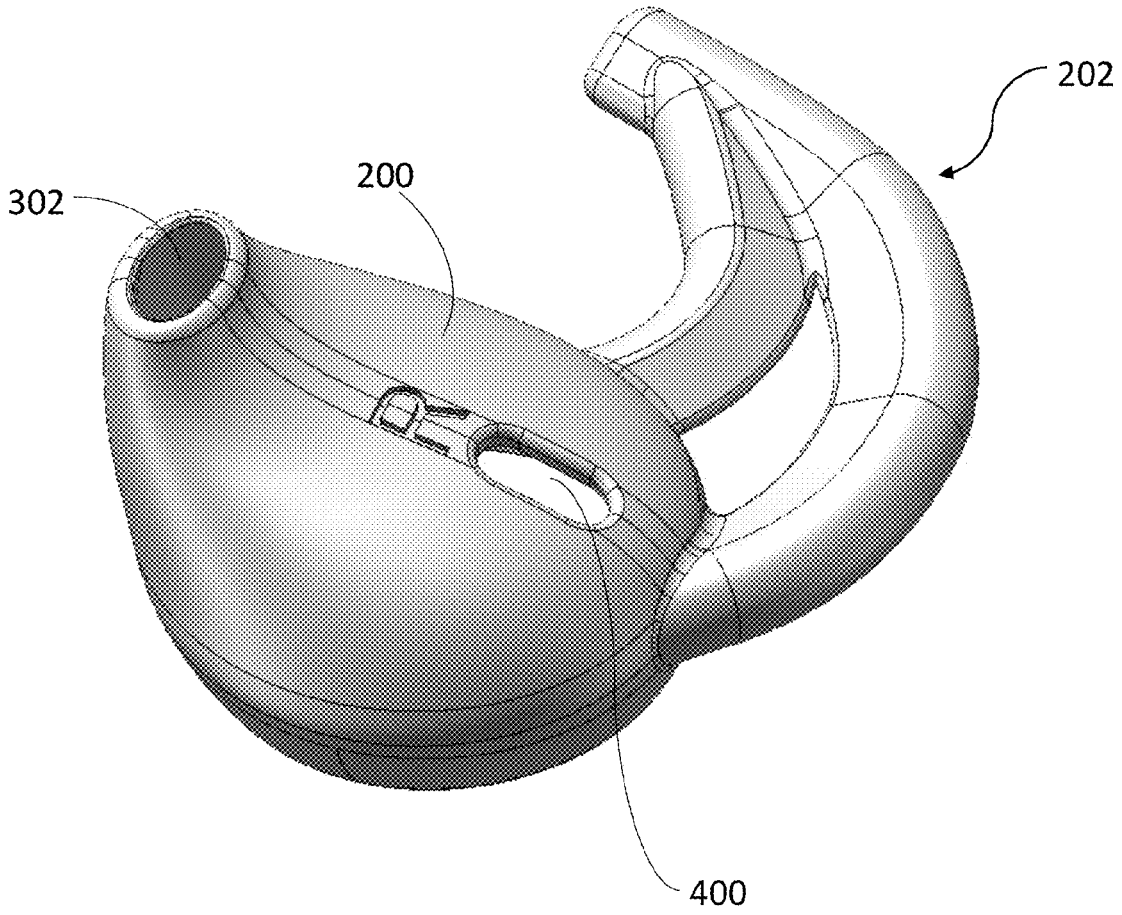
FIG. 4 shows a perspective view of the front of the earbud headphone adapter of FIG. 1.

FIG. 4 shows a perspective view of the front of the earbud headphone adapter 100 of FIGS. 1-3. As shown in FIG. 4, the hollow body 200 may further include a third opening 400, the third opening 400 being located on the hollow body 200 between the first plane 301 and the second plane 304. The third opening 400 may be offset from the earbud axis 300 in a second direction, the second direction being opposite the first direction 307. In one embodiment, the third opening 400 preserves and enhances the sound quality of an earbud headphone 100 by preventing of the hollow body 200 from covering additional openings on an earbud headphone 101. Many earbud headphones have more than one opening. Additional openings on the earbud headphone 101 may provide pressure relief and/or additional speaker output holes. The third opening 400 is configured to correspond to such additional openings of said earbud headphone 101 when said earbud headphone 101 is inserted into the earbud headphone adapter 100, according to some embodiments. For example the third opening 400 may allow sound emitted from such additional openings or other areas of the speakers of said earbud headphones to exit the hollow body 200 and enter the outer structure of the ear of a user when worn. The presence of two openings through which sound can pass, namely the sound opening 302 and the third opening 400 according to one embodiment, further improves the relative sound quality. Where said earbud headphones include speakers that are not designed to be inserted into a user's ear canal, the absence of the third opening 400 may in some cases result in increased vibratory feedback caused by sounds emitted from the earbud headphone 101, in turn decreasing the overall quality of the sound and experience of the user.

Figure 5:
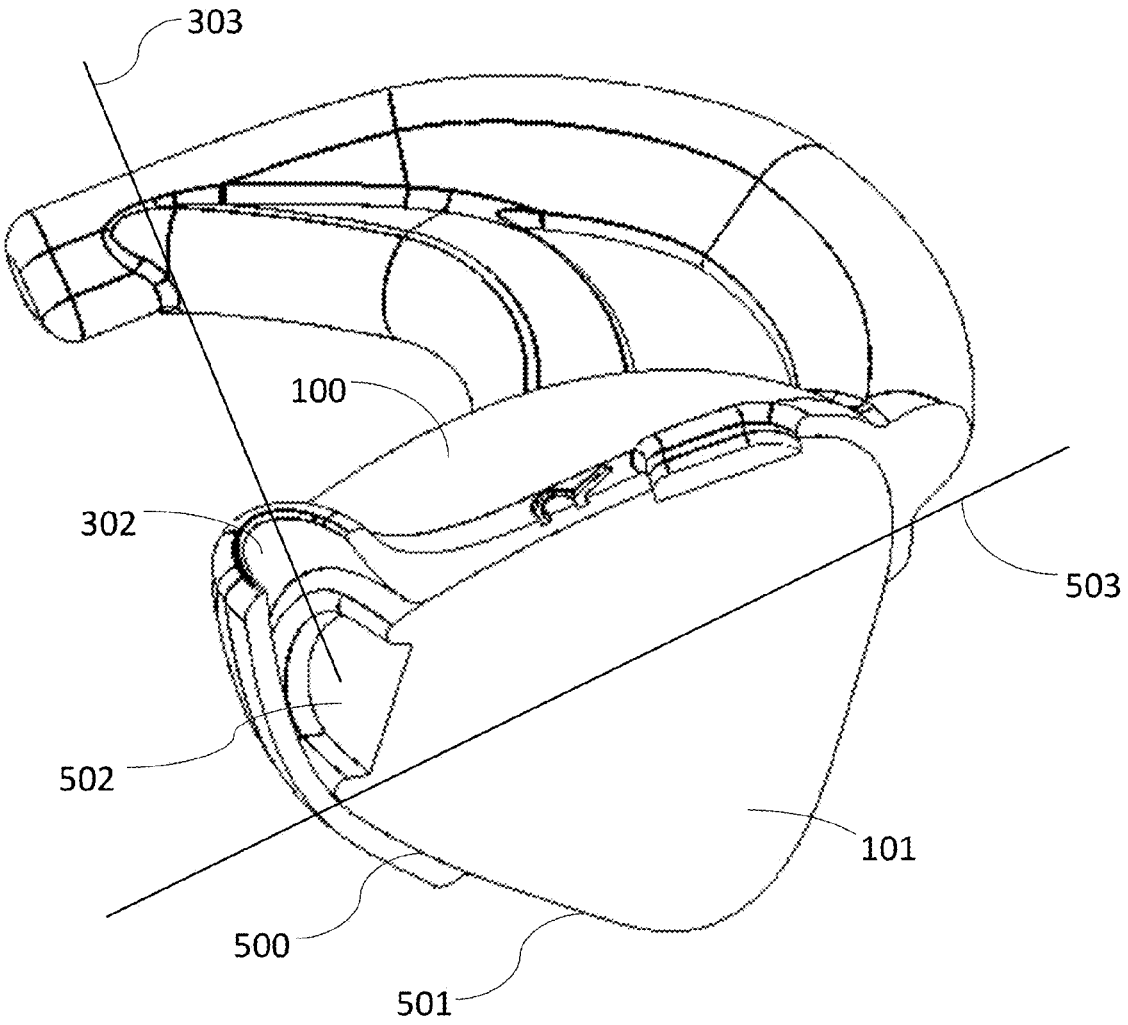
FIG. 5 shows a perspective, cross-sectional view of the earbud headphone adapter of FIG. 1 fitted over an earbud headphone, taken along plane A-A of FIG. 6.

FIG. 5 shows a perspective cross-sectional view, taken along plane A-A of FIG. 6, of the earbud headphone adapter 100 fitted over an earbud headphone 101, according to one embodiment. A side 500 of the cavity 308 is configured to conform to at least one side 501 of the earbud headphone 101 when the earbud headphone 101 is inserted into the earbud headphone adapter 100. In some embodiments, an earbud sound output 502 of the earbud headphone 101 may be oriented in such a way as to not emit sound directly into the ear canal opening 306 of a user. It may be advantageous for the earbud headphone adapter 100 to grip the earbud headphone 101 along a first headphone axis 503 and direct sound emitted from the earbud sound output 502 to exit the sound opening 302 in the direction of the sound opening axis 303.

FIG. 6 shows a front view of an embodiment of the present disclosure. As noted above, the stabilizer 202 can be shaped to engage with features of the human ear to provide a secure fit between the earbud headphone 101 and a wearer. Providing such a secure fit can involve forming a stabilizer 202 structure that has both desired overall shape and strength characteristics. Accordingly, the stabilizer can include any suitable legs, arcs, and/or other features for enabling such a secure fit. The stabilizer 202 of the earbud headphone adapter 100 may be formed in a crescent shape according to one embodiment, as shown in FIG. 6. The stabilizer 202 extends from the hollow body 200 at an outer surface 603 of the hollow body 200 and generally along the first plane 301 in the second direction (opposite the first direction). In some embodiments the stabilizer 202 extends from the hollow body 200 at a first stabilize base portion 606 and a second stabilizer base portion 607. In certain embodiments the stabilizer is substantially opposite from the sound opening 302 at the point at which it extends from the hollow body 200 and located vertically upwards from the earbud axis 300 when the earbud headphone adapter 100 is worn in the ear of a user. The stabilizer 202 is configured to contact a cymba concha area 701 of the ear of a user when worn such that the sound opening 302 is within the ear canal opening, as further illustrated by FIGS. 7 and 8. The stabilizer 202, in extending away from the hollow body 200 along the first plane 301, curves back toward the sound opening 302 in a partial spiral configuration, causing it to take on a crescent shape. The crescent-shaped stabilizer 202 ends at a stabilizer point 605 in a manner designed to couple with the anatomical structure of a user's ear when worn. The stabilizer 202 may further comprise a first arm 601 and a second arm 602 to increase flexibility and capacity for physical compliance, which accommodates various anatomical dimensions of users' ears. The longer outer edge 600 of the stabilizer 202, shown in FIG. 6 along the outer edge of the first arm 601 of the stabilizer 202, is positioned to contact the cymba concha area 701 of a user's ear (shown in FIG. 7). In such an embodiment, the first arm 601 and the second arm 602 extend from the hollow body 200 at two different locations and join at a juncture 604. The stabilizer 202 has a hollow portion between said arms 601, 602 in one embodiment. The hollow portion could also have additional embodiments between said arms 601, 602, including this area being solid, having a mesh pattern, or other structures connecting the arms 601 and 602. According to some embodiments the stabilizer has alternative shapes that are adapted to interface with the cymba concha including for example the arms of the stabilizer 202 may be hollow, the stabilizer may also have only one arm, more than two arms, no arms, or any number of structures. The outer edge 600 of the stabilizer 202 may take on a variety of shapes, and does not necessarily have to be a continuous curve. Other embodiments may have the stabilizer 202 not generally formed along the first plane 301 or there could be one or more portions that do not conform to the first plane 301 in either direction. Likewise, the stabilizer 202 may attach to the hollow body 200 at different points than shown in FIG. 6.

FIG. 7 shows a side view of a human ear 700, the ear comprising a cymba concha area 701, a cavum concha 702, an antihelix, a crus of helix, a crus of antihelix 703, and an ear canal opening 306.

FIG. 8 shows the earbud headphone adapter 100 positioned in the ear 700 of FIG. 7 as it is worn by a user, according to one embodiment. The stabilizer 202 is configured to contact the cymba concha area 701 such that the earbud headphone adapter 100 is secured to the ear 700 when the sound opening 302 is within the ear canal opening 306 of a user. In such an embodiment, this configuration helps prevent the earbud headphone adapter 100 from coming loose or falling out of the ear 700 of the user during movement or physical activity. According to some embodiments the stabilizer 202 engages the cymba concha area 701 by fitting under antihelix 703, when the sound opening 302 is within the ear canal opening 306 of a user. The stabilizer 202 may further extend along the cymba concha area 701 until its termination point between the crus of helix and the crus of antihelix.

The hollow body 200 and the stabilizer 202 may be made out of any suitable flexible material, including without limitation silicone having a 55 shore A durometer hardness, according to one embodiment. The hardness optimizes both flexibility and structural integrity according to some embodiments of the present disclosure.

FIGS. 9-15 illustrate an additional embodiment of an earphone headphone adapter.

In other embodiments, at least a portion of the earbud headphone adapter or aspects thereof may be implemented as part of the earbud headphone itself, such that at least a portion of the earbud headphone adapter is configured to be fixed or sealed to the earbud headphone. For example, at least a portion of the earbud headphone adapter may be fixed or sealed onto the earbud headphone by an adhesive or through the manufacturing process of the earbud headphone, the earbud adapter, or both. In some embodiments, the earbud opening is fixed or sealed onto the earbud headphone and is configured to be non-removable from the earbud headphone by a user. In such embodiments, the earbud opening is not necessarily stretched over the earbud headphone, but may be wrapped around the earbud headphone and then fixed or sealed to the earbud headphone. Further, in some embodiments, the cavity may be fixed or sealed onto the earbud headphone (in addition to the earbud opening) and is configured to be non-removable from the earbud headphone by a user. In such embodiments, the stabilizer may also be fixed or sealed to the portion of hollow body that is fixed or sealed to the earbud headphone. In other embodiments, the stabilizer may be fixed or sealed directly to an earbud headphone that is shaped substantially as embodiments of the earbud adapter described in this disclosure.

While a number of aspects and embodiments have been discussed above, persons having ordinary skill in the art will recognize certain modifications, permutations, additions, and equivalents may alternatively be used or introduced. It is intended that the scope of the following claims are interpreted to include all such modifications, permutations, additions, and equivalents. The terms and expressions used herein are for description, not limitation, and there is no intention to exclude any equivalents of the aspects shown and described.

What is claimed is:

1. An earbud headphone adapter comprising:

a hollow body having:

an earbud opening, the earbud opening extending about an earbud axis, the earbud axis being normal to a first plane, the earbud opening is configured to fit over an earbud headphone, the hollow body tapering along at least a portion of the hollow body from the earbud opening to a sound opening, the sound opening extending about a sound opening axis, the sound opening axis being normal to the first plane, wherein the circumference of the sound opening is parallel to and offset from the first plane, wherein a first cross-sectional area of the earbud opening at the first plane is larger than a second cross-sectional area of the sound opening, the sound opening of the hollow body being dimensioned to fit within an ear canal opening of an ear, and wherein the sound opening axis is offset from the earbud axis along a first direction;

a cavity extending from the first plane to the earbud opening, wherein the circumference of the earbud opening is parallel to and offset from the first plane, wherein the first plane is situated between the earbud opening and the sound opening, wherein a first distance between opposite sides of the cavity on the first plane is larger than a second distance between opposite sides of the cavity on the earbud opening, the cavity configured to receive the earbud headphone, and wherein the cavity is formed of a material configured to stretch over the earbud headphone to securely retain it; and a stabilizer configured to engage a cymba concha area of the ear while the sound opening is within the ear canal opening, the stabilizer positioned normal to the sound opening axis, such that the stabilizer defines the first plane, the stabilizer extending from a portion of the hollow body that is offset from the earbud axis in a second direction that is opposite the first direction.

2. The earbud headphone adapter of claim 1, wherein the hollow body further comprises a third opening, the third opening located between the first plane and the sound opening.

3. The earbud headphone adapter of claim 2, wherein the third opening is offset from the earbud axis along the second direction.

4. The earbud headphone adapter of claim 3, wherein the third opening is sized and positioned to reduce vibratory feedback caused by sounds emitted from the earbud headphone.

5. The earbud headphone adapter of claim 1, wherein the hollow body has a uniform wall thickness.

6. The earbud headphone adapter of claim 1, wherein the hollow body and the stabilizer are comprised of a silicone material.

7. The earbud headphone adapter of claim 6, wherein the silicone material has a 55 shore A durometer hardness.

8. The earbud headphone adapter of claim 1, wherein at least one side of the cavity contacts at least one side of the earbud headphone when the earbud headphone is inserted in the hollow body.

9. The earbud headphone adapter of claim 1, wherein an outer edge of the stabilizer curves toward the sound opening along the first plane, the outer edge positioned to contact the cymba concha area of the ear while the sound opening is within the ear canal opening.

10. The earbud headphone adapter of claim 1, wherein the stabilizer further comprises a first arm and a second arm, wherein the first arm and the second arm extend from the hollow body at different locations, the first arm extending from the hollow body opposite from the sound opening, wherein the first arm and the second arm join at a juncture configured to engage the cymba concha area of the ear while the sound opening is within the ear canal opening.

* * * * *